US010825641B2

(12) United States Patent
Ishii et al.

(10) Patent No.: US 10,825,641 B2
(45) Date of Patent: Nov. 3, 2020

(54) X-RAY TUBE

(71) Applicant: HAMAMATSU PHOTONICS K.K., Hamamatsu (JP)

(72) Inventors: Atsushi Ishii, Hamamatsu (JP); Tutomu Inazuru, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/380,259

(22) Filed: Apr. 10, 2019

(65) Prior Publication Data

US 2019/0318903 A1 Oct. 17, 2019

(30) Foreign Application Priority Data

Apr. 12, 2018 (JP) ..... 2018-076993

(51) Int. Cl.
*H01J 35/16* (2006.01)
*H01J 35/08* (2006.01)

(52) U.S. Cl.
CPC ..... *H01J 35/16* (2013.01); *H01J 35/112* (2019.05); *H01J 2235/165* (2013.01); *H01J 2235/168* (2013.01)

(58) Field of Classification Search
CPC .. H01J 2235/16; H01J 35/16; H01J 2235/165; H01J 2235/168; H01J 35/112
See application file for complete search history.

(56) References Cited

U.S. PATENT DOCUMENTS 2,836,748 A * 5/1958 Atlee ..... H01J 35/16 378/139
2009/0238340 A1* 9/2009 Okada ..... H01J 35/16 378/140

FOREIGN PATENT DOCUMENTS

JP 2009-245806 A 10/2009
JP 4876047 B2 2/2012
JP 5800578 B2 10/2015

* cited by examiner

*Primary Examiner* — Chih-Cheng Kao
(74) *Attorney, Agent, or Firm* — Faegre Drinker Biddle & Reath LLP

(57) ABSTRACT

An X-ray tube includes a metal portion in which an X-ray emission window is provided, an insulation valve which is joined to the metal portion and forms a vacuum region in cooperation with the metal portion, and a target and an electron gun which are accommodated in the vacuum region. The insulation valve has a low resistivity glass portion joined to the metal portion, and a high resistivity glass portion for fixing an anode including the target. A volume resistivity of a material forming the low resistivity glass portion is lower than a volume resistivity of a material forming the high resistivity glass portion. According to this configuration, electrification of the insulation valve is curbed, so that deterioration in withstand voltage ability of the insulation valve is curbed, and electric discharge caused by electrification is curbed.

15 Claims, 8 Drawing Sheets

93
P1
P2
P3
P4
P5
P6
93a
93b
92
96
98
95
S6
S5
94
R1
97
99
91

X-RAY TUBE

TECHNICAL FIELD

An aspect of the present invention relates to an X-ray tube.

BACKGROUND

X-ray tubes generate X-rays by causing electrons to collide with a target. In order to guide electrons to the target, a high voltage is applied to the target, for example. On the other hand, a voltage applied to a target generates a potential difference between the target and other members. This potential difference causes unnecessary electric discharge. Sometimes electric discharge causes damage to components constituting an X-ray tube. For example, Japanese Patent No. 4876047 discloses a technology of curbing creeping discharge caused by adhered dust. Japanese Unexamined Patent Publication No. 2009-245806 discloses a technology of stably curbing damage to constituent components caused by electric discharge. Japanese Patent No. 5800578 discloses a technology for improving a withstand voltage.

Recently, there has been demand for X-ray tubes having a high output. In order to realize a high output, there are cases in which a higher voltage is supplied to an X-ray tube. As a result, unnecessary electric discharge is more likely to occur. In order to curb occurrence of unnecessary electric discharge, it is important that the withstand voltage between constituent components is increased. Moreover, in order to curb unnecessary electric discharge, it is also important that deterioration in withstand voltage of constituent components is curbed.

An object of an aspect of the present invention is to provide an X-ray tube in which deterioration in withstand voltage is curbed and electric discharge is minimized.

SUMMARY

According to an aspect of the present invention, there is provided an X-ray tube including a metal portion in which an X-ray emission unit is provided, a valve portion which is joined to the metal portion and forms a vacuum region in cooperation with the metal portion, and an electron gun and a target which are accommodated in the vacuum region. The valve portion has a first partition wall portion joined to the metal portion, and a second partition wall portion for fixing either of the electron gun or the target. A volume resistivity of a material forming the first partition wall portion is lower than a volume resistivity of a material forming the second partition wall portion.

DETAILED DESCRIPTION

Figure 1:
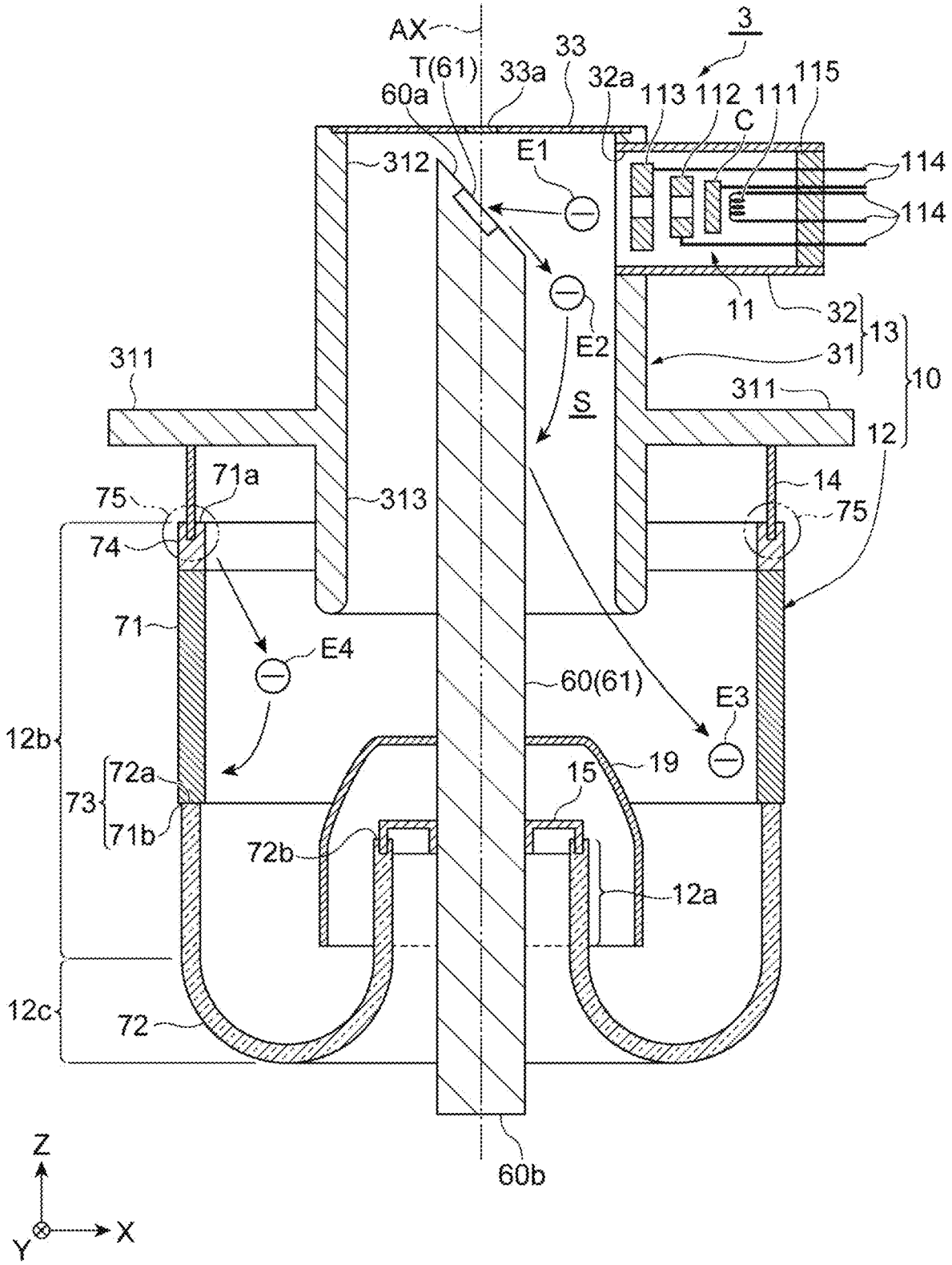
FIG. 1 is a cross-sectional view illustrating a configuration of an X-ray tube of an embodiment.

According to an aspect of the present invention, there is provided an X-ray tube including a metal portion in which an X-ray emission unit is provided, a valve portion which is joined to the metal portion and forms a vacuum region in cooperation with the metal portion, and an electron gun and a target which are accommodated in the vacuum region. The valve portion has a first partition wall portion joined to the metal portion, and a second partition wall portion for fixing either of the electron gun or the target. A volume resistivity of a material forming the first partition wall portion is lower than a volume resistivity of a material forming the second partition wall portion.

Electrons generated inside an X-ray tube are incident on the valve portion. As a result, the valve portion is electrified. Due to electrification of the valve portion, in an X-ray tube using the valve portion, the withstand voltage of the valve portion deteriorates sometimes. For example, there are cases in which electrons emitted from an electron gun are incident on a target. A part of the electrons incident on the target are reflected by the target without being converted into X-rays or heat. There are cases in which reflected electrons are incident on a valve portion. From the viewpoint of efficiency of utilizing X-rays, a target is often provided in the vicinity of an X-ray emission unit. When a target is provided in the vicinity of an X-ray emission unit, reflected electrons are likely to be incident on a side joined to a metal portion of the valve portion in which the X-ray emission unit is provided. Therefore, the valve portion of the X-ray tube has the first partition wall portion joined to the metal portion, and the second partition wall portion for fixing either of the electron gun or the target. Moreover, the volume resistivity of a material forming the first partition wall portion is lower than the volume resistivity of a material forming the second partition wall portion. As a result, in the first partition wall portion, incident electrons easily move. Therefore, electrification of the valve portion can be curbed. As a result, deterioration in withstand voltage is curbed, and it is possible to minimize electric discharge caused by electrification.

The valve portion may have a partition wall joint portion in which the first partition wall portion is joined to the second partition wall portion. According to this configuration, the first partition wall portion can be joined to the second partition wall portion at a desired position. As a result, a region of the valve portion in which electrification is to be curbed can be controlled in a desired form.

The valve portion may have a first cylinder portion which includes the first partition wall portion, a second cylinder portion which is disposed inside the first cylinder portion and includes the second partition wall portion, and a coupling portion which causes the first cylinder portion to be coupled to the second cylinder portion. According to this configuration, the overall length of the valve portion can be lengthened. As a result, creeping discharge occurring in an inner wall of the valve portion can be curbed.

The first cylinder portion may include the partition wall joint portion. In addition, the coupling portion may include the partition wall joint portion. According to these configurations, a region in which electrification is curbed in the valve portion can be controlled in a desired form.

The volume resistivity of the first partition wall portion may increase from an end portion joined to the metal portion toward the partition wall joint portion. According to this configuration, a valve portion having a desired volume resistivity can be easily manufactured.

The first partition wall portion may include a plurality of first partition wall piece portions differing from each other in volume resistivity. The plurality of first partition wall piece portions may be disposed such that the volume resistivity increases from an end portion joined to the metal portion toward the partition wall joint portion. According to this configuration as well, a valve portion having a desired volume resistivity can be easily manufactured.

The volume resistivity of the second partition wall portion may increase from the partition wall joint portion toward an end portion joined to either of the electron gun or the target. According to this configuration as well, a valve portion having a desired volume resistivity can be easily manufactured.

The second partition wall portion may include a plurality of second partition wall piece portions differing from each other in volume resistivity. The plurality of second partition wall piece portions may be disposed such that the volume resistivity increases from the partition wall joint portion toward an end portion joined to either of the electron gun or the target. According to this configuration as well, a valve portion having a desired volume resistivity can be easily manufactured.

The metal portion may have a protrusion portion covering a joint part between the metal portion and the first partition wall portion. According to this configuration, electric discharge occurring at a joint place between the valve portion and the metal portion can be curbed.

The valve portion may be an integrated body formed such that the volume resistivity continuously increases from the first partition wall portion toward the second partition wall portion. According to this configuration as well, a valve portion having a desired volume resistivity can be easily manufactured.

The volume resistivity of a material forming the first partition wall portion may be within a range of $10^{-5}$ times to $10^{-2}$ times the volume resistivity of a material forming the second partition wall portion. According to this configuration, electrification of the valve portion can be stably curbed.

The material forming the first partition wall portion and the material forming the second partition wall portion may be glasses. According to this configuration as well, a valve portion having a desired volume resistivity can be easily manufactured.

According to the aspect of the present invention, it is possible to provide an X-ray tube in which deterioration in withstand voltage is curbed and electric discharge is minimized.

Hereinafter, an embodiment for performing the present invention will be described in detail with reference to the accompanying drawings. The same reference signs are applied to the same elements in description of the drawings, and duplicated description will be omitted.

A configuration of an X-ray tube 3 will be described. As illustrated in FIG. 1, the X-ray tube 3 is a so-called reflective X-ray tube. The X-ray tube 3 includes a vacuum housing 10, an electron gun 11, and a target T. The vacuum housing 10 is a vacuum envelope internally maintaining a vacuum state. The electron gun 11 is an electron generation unit. The electron gun 11 has a cathode C. For example, the cathode C has a base body which is formed of a high melting-point metal material or the like and a substance which has been impregnated in the base body and easily emits electrons. The target T has a plate shape. For example, the target T is formed of a high melting-point metal material such as tungsten. A position at the center of the target T overlaps a tube axis AX of the X-ray tube 3. The electron gun 11 and the target T are accommodated inside the vacuum housing 10. Electrons emitted from the electron gun 11 are incident on the target T. As a result, the target T generates X-rays. The generated X-rays are radiated outside through an X-ray emission window 33*a*.

The vacuum housing 10 has an insulation valve 12 (valve portion) and a metal portion 13. The insulation valve 12 is formed of an insulating material. Examples of an insulating material include glass. The metal portion 13 has the X-ray emission window 33*a* (X-ray emission unit). The vacuum housing 10 has an inner space S. The metal portion 13 has a main body portion 31 and an electron gun accommodation portion 32. The main body portion 31 accommodates the target T. The electron gun accommodation portion 32 accommodates the electron gun 11 serving as a cathode.

The main body portion 31 has a tubular shape. A lid plate 33 is fixed to one end portion (outer end portion) of the main body portion 31. The lid plate 33 has the X-ray emission window 33*a*. The material of the X-ray emission window 33*a* is an X-ray transmission material. Examples of an X-ray transmission material include beryllium and aluminum. The lid plate 33 closes one end side of the inner space S. The main body portion 31 has a flange portion 311, a cylinder portion 312, and a protrusion portion 313. The flange portion 311 is provided in the outer circumference of the main body portion 31. The flange portion 311 is fixed to an X-ray generation device (not illustrated). The cylinder portion 312 is formed on one end portion side of the main body portion 31. The cylinder portion 312 has a cylindrical shape. The protrusion portion 313 is connected to the other end portion of the cylinder portion 312. The protrusion portion 313 protrudes in a tube axis direction (Z-direction) of the X-ray tube 3. The protrusion portion 313 protrudes to the inner space S. The protrusion portion 313 blocks a connection portion between the insulation valve 12 and a ring member 14 from an anode 61 (target supporting portion 60).

The electron gun accommodation portion 32 has a cylindrical shape. The electron gun accommodation portion 32 is fixed to a side portion of the main body portion 31 on one end portion side. The center axis line of the main body portion 31 is substantially orthogonal to the center axis line of the electron gun accommodation portion 32. In other words, the tube axis AX of the X-ray tube 3 is substantially orthogonal to the center axis line of the electron gun accommodation portion 32. An opening 32*a* is provided in an end portion of the electron gun accommodation portion 32 on the main body portion 31 side. The inside of the electron gun accommodation portion 32 communicates with the inner space S of the main body portion 31 through the opening 32*a*.

The electron gun 11 includes the cathode C, a heater 111, a first grid electrode 112, and a second grid electrode 113. In the electron gun 11, the beam diameter of an electron beam generated in cooperation with the constituent components can be reduced. In other words, the electron gun 11 can perform micro-focusing of an electron beam. The cathode C, the heater 111, the first grid electrode 112, and the second grid electrode 113 are attached to a stem substrate 115 with a plurality of power feeding pins 114 interposed therebetween. The plurality of power feeding pins 114 extend in a manner of being parallel to each other. The cathode C, the heater 111, the first grid electrode 112, and the second grid electrode 113 receive electric power from the outside with the corresponding power feeding pins 114 interposed therebetween.

The insulation valve 12 has a substantially tubular shape. The ring member 14 is fused into one end portion of the insulation valve 12. The ring member 14 is formed of a metal or the like. The ring member 14 is joined to the main body portion 31. Due to this joining, one end side of the insulation valve 12 is connected to the main body portion 31 with the ring member 14 interposed therebetween. An inner cylinder portion 12*a* is provided on the other end side of the insulation valve 12. The inner cylinder portion 12*a* extends toward the inner side of the insulation valve 12. In addition, the inner cylinder portion 12*a* has a cylindrical shape. The other end portion of the insulation valve 12 is folded back to the inner side throughout the whole circumference, such that a hole portion is defined in a middle portion of the insulation valve 12 when viewed in the Z-direction.

The inner cylinder portion 12*a* of the insulation valve 12 holds the anode 61 (target supporting portion 60) with a fixing portion 15 interposed therebetween. The target supporting portion 60 has a rod shape. In addition, the target supporting portion 60 has a columnar shape. For example, the target supporting portion 60 is formed of a copper material or the like. The target supporting portion 60 extends in the Z-direction. An inclined surface 60*a* is formed at the distal end of the target supporting portion 60. The inclined surface 60*a* is inclined away from the electron gun 11 while going from the insulation valve 12 side toward the main body portion 31 side. The target T is buried in an end portion of the target supporting portion 60. The target T is flush with the inclined surface 60*a*.

A proximal end portion 60*b* of the target supporting portion 60 protrudes outward beyond a lower end portion of the insulation valve 12. In other words, the proximal end portion 60*b* of the anode 61 protrudes outward beyond a folded-back position. The proximal end portion 60*b* of the target supporting portion 60 (anode 61) is connected to a power source. In the present embodiment, the vacuum housing 10 has the ground potential. Therefore, the metal portion 13 has the ground potential. The anode 61 (target supporting portion 60) receives a high positive voltage from the power source. The anode 61 may receive a voltage from the power source in a form different from a high positive voltage.

The fixing portion 15 is formed of a metal or the like. The fixing portion 15 fixes the target supporting portion 60 to the other end portion of the insulation valve 12. In other words, the fixing portion 15 fixes the target supporting portion 60 to an upper end portion 72*b* of the inner cylinder portion 12*a*. One end side of the fixing portion 15 is fixed to the target supporting portion 60. The other end side of the fixing portion 15 is fused into the upper end portion 72*b* of the inner cylinder portion 12*a*. Due to this fusion, the target supporting portion 60 (anode 61) is fixed to extend along the tube axis AX. Moreover, it is vacuum-sealed. That is, the axis line of the anode 61 is coaxial with the axis line of the tube axis AX. Moreover, it is vacuum-sealed by the fixing portion 15.

A cover electrode 19 is an electrode member. The cover electrode 19 surrounds a fusion part (joint part) between the inner cylinder portion 12*a* of the insulation valve 12 and the fixing portion 15 from the outer side. The cover electrode 19 has a substantially cylindrical shape. The cover electrode 19 has a distal end portion and a proximal end portion. The distal end portion is fixed to the target supporting portion 60. In addition, the distal end portion has a substantially truncated cone shape. The proximal end portion has a cylindrical shape. The distal end portion is smoothly connected to the proximal end portion. Sometimes the insulation valve 12 is damaged due to electric discharge to the fusion part. The cover electrode 19 prevents damage to the insulation valve 12.

Hereinafter, with reference to FIG. 1, the insulation valve 12 will be described in more details. The insulation valve 12 is an integrally molded article. The insulation valve 12 includes the inner cylinder portion 12*a* (second cylinder portion), an outer cylinder portion 12*b* (first cylinder portion), and a coupling portion 12*c*. In addition, the target T and the target supporting portion 60 supporting the target T constitute the anode 61. The anode 61 and the electron gun 11 constitute an X-ray generation unit. Moreover, the metal portion 13 and the insulation valve 12 form a vacuum region (inner space S).

The inner cylinder portion 12*a* has a cylindrical shape. The diameter of the inner cylinder portion 12*a* is uniform in a direction of the tube axis AX in the insulation valve 12. The inner cylinder portion 12*a* has a tubular shape. The inner cylinder portion 12*a* is thinner than the outer cylinder portion 12*b*. That is, the outer diameter of the inner cylinder portion 12*a* is smaller than the inner diameter of the outer cylinder portion 12*b*. The axis line of the inner cylinder portion 12*a* overlaps the tube axis AX. One end portion of the inner cylinder portion 12*a* is disposed inside the outer cylinder portion 12*b*. The other end portion of the inner cylinder portion 12*a* is disposed on the inner side of the cover electrode 19. The inner cylinder portion 12*a* is fused into the fixing portion 15. The inner cylinder portion 12*a* leads to the coupling portion 12*c*. The length along the tube axis AX of the inner cylinder portion 12*a* is shorter than the length along the tube axis AX of the outer cylinder portion 12*b*.

The outer cylinder portion 12*b* has a cylindrical shape. The outer cylinder portion 12*b* forms the outer shape of the insulation valve 12. The diameter of the outer cylinder portion 12*b* is uniform in the direction of the tube axis AX in the insulation valve 12. The outer cylinder portion 12*b* is fused into one end of the ring member 14 with a glass coupling portion 74 interposed therebetween. The glass coupling portion 74 is made of Kovar glass. The ring member 14 is made of a metal. The outer cylinder portion 12*b* is joined to the main body portion 31 with the ring member 14 interposed therebetween. The ring-shaped outer cylinder portion 12*b* extends in the direction of the tube axis AX from the glass coupling portion 74.

Similar to the inner cylinder portion 12*a*, the axis line of the outer cylinder portion 12*b* also overlaps the tube axis AX. A gap is formed between the outer circumferential surface of the inner cylinder portion 12*a* and the inner circumferential surface of the outer cylinder portion 12*b*. The diameter of the inner cylinder portion 12*a* and the diameter of the outer cylinder portion 12*b* are uniform in the direction of the tube axis AX in the insulation valve 12. Therefore, according to the coaxial disposition, the distance (gap) from the inner circumferential surface of the inner cylinder portion 12*a* to the outer circumferential surface of the outer cylinder portion 12*b* is uniform along the tube axis AX. In other words, the inner circumferential surface of the inner cylinder portion 12*a* is parallel to the outer circumferential surface of the outer cylinder portion 12*b*. The cover electrode 19 is disposed between the inner cylinder portion 12*a* and the outer cylinder portion 12*b*. The outer circumferential surface of the inner cylinder portion 12*a* does not directly face the inner circumferential surface of the outer cylinder portion 12*b*.

The coupling portion 12*c* causes the outer cylinder portion 12*b* to be coupled to the inner cylinder portion 12*a*. The gap is formed between the inner cylinder portion 12*a* and the outer cylinder portion 12*b*. The coupling portion 12*c* closes this gap. The coupling portion 12*c* has a toric surface shape. In other words, the coupling portion 12*c* has a torus shape.

The shape of the insulation valve 12 has been described while dividing it into three parts of the inner cylinder portion 12*a*, the outer cylinder portion 12*b*, and the coupling portion 12*c*. The insulation valve 12 can be further divided into two parts based on the material characteristics.

The insulation valve 12 has a low resistivity glass portion 71 (first partition wall portion) and a high resistivity glass portion 72 (second partition wall portion). The low resistivity glass portion 71 is joined to the high resistivity glass portion 72 in a glass joint portion 73 (partition wall joint portion). In the insulation valve 12, the material itself forming the insulation valve 12 has a difference in volume resistivity. In the glass joint portion 73, an end portion 71*b* of the low resistivity glass portion 71 is joined to one end portion 72*a* of the high resistivity glass portion 72. The volume resistivity of the low resistivity glass portion 71 is different from the volume resistivity of the high resistivity glass portion 72. The expressions "low resistivity" and "high resistivity" indicate relative differences in volume resistivity between the low resistivity glass portion 71 and the high resistivity glass portion 72. That is, the expression "low resistivity" denotes that the volume resistivity of the low resistivity glass portion 71 is smaller than the volume resistivity of the high resistivity glass portion 72. Electrons incident on the low resistivity glass portion 71 easily move, compared to electrons incident on the high resistivity glass portion 72. Therefore, the low resistivity glass portion 71 is unlikely to be electrified, compared to the high resistivity glass portion 72. As an example, the volume resistivity of the low resistivity glass portion 71 is within a range of $10^{-5}$ times to $10^{-2}$ times the volume resistivity of the high resistivity glass portion 72. For example, the low resistivity glass portion 71 is formed of borosilicate glass having a volume resistivity of approximately $10^{15}$ [Ω cm]. The high resistivity glass portion 72 is formed of borosilicate glass having a volume resistivity of $10^{18}$ [Ω cm]. In FIG. 1 and the like, in order to facilitate understanding, the thickness of the low resistivity glass portion 71 and the thickness of the high resistivity glass portion 72 are different from each other. This thickness is the thickness of the constituent glass member. However, the thicknesses of the walls may be the same as each other, or the size relationship between the thicknesses may be reversed.

The outer cylinder portion 12*b* includes the entire low resistivity glass portion 71 and a part of the high resistivity glass portion 72. The outer cylinder portion 12*b* includes the glass joint portion 73. The coupling portion 12*c* and the inner cylinder portion 12*a* include the remaining part of the high resistivity glass portion 72. The coupling portion 12*c* in its entirety is constituted of the high resistivity glass portion 72. The inner cylinder portion 12*a* in its entirety is also constituted of the high resistivity glass portion 72.

Attention will be focused on the volume resistivity of the insulation valve 12. The insulation valve 12 includes two parts having volume resistivities different from each other between the ring member 14 and the fixing portion 15. Specifically, the volume resistivity on the metal portion 13 side is smaller than the volume resistivity on the fixing portion 15 side. According to this configuration, at least a part of the anode 61 (target supporting portion 60) and the cover electrode 19 is surrounded by the low resistivity glass portion 71. In other words, the anode 61 (target supporting portion 60) and the cover electrode 19 face the low resistivity glass portion 71 having a relatively low volume resistivity.

Here, a DC voltage is applied to the anode 61 (target supporting portion 60). As a result, a DC electric field is formed inside the insulation valve 12. The inside of the insulation valve 12 includes a region between the inner circumferential surface of the outer cylinder portion 12*b* and the outer circumferential surface of the anode 61 (target supporting portion 60), and a region between the inner circumferential surface of the outer cylinder portion 12*b* and the outer circumferential surface of the cover electrode 19. The intensity of an electric field in an insulator present in a DC electric field is determined depending on the value of the volume resistivity. For example, an electric field is likely to be concentrated in a region having a high volume resistivity. In the insulation valve 12, the relationship between a region occupied by the low resistivity glass portion 71 and a region occupied by the high resistivity glass portion 72 affects an electric field generated inside the insulation valve 12. The region occupied by the low resistivity glass portion 71 and the region occupied by the high resistivity glass portion 72 are indicated by the position of the glass joint portion 73.

The glass joint portion 73 of the insulation valve 12 is provided in the outer cylinder portion 12*b*. In more details, the glass joint portion 73 is provided between a position facing one end of the cover electrode 19 and a position facing the other end of the cover electrode 19. In other words, the glass joint portion 73 is provided between a position facing the end portion of the fixing portion side with respect to the anode 61 (target supporting portion 60) and a position facing the other end of the cover electrode 19. This range includes a configuration in which the glass joint portion 73 faces the one end of the cover electrode 19. Similarly, this range also includes a configuration in which the glass joint portion 73 faces the other end of the cover electrode 19. According to such a position of the glass joint portion 73, occurrence of electrification on an inner wall surface of the insulation valve 12 is curbed. Therefore, deterioration in withstand voltage can be curbed, and electric discharge can be curbed.

Hereinafter, causes for electrification of the insulation valve 12 will be described in more details. Two causes are conceived for electrification of the insulation valve 12. A first cause is reflected electrons incident on the insulation valve 12. A second cause is electrons incident on the insulation valve 12 after being generated due to field emission (FE).

[Reflected Electrons Being Incident]

For example, electrons E1 incident on the target T are emitted again at a constant ratio without being converted into X-rays or heat. Electrons which have been emitted again are reflected electrons E2. A part of the reflected electrons E2 fly inside the insulation valve 12. A part of the reflected electrons E2 are reflected by the anode 61 (target supporting portion 60) and the like while flying. Then, a part of the reflected electrons E2 are incident on the inner wall surface of the outer cylinder portion 12*b*. Incident electrons are electrons E3.

The electrons E1 are accelerated in the electron gun 11 due to a desired potential difference. The accelerated electrons E1 are incident on the target T. When the accelerated electrons E1 are reflected by the target T, the reflected electrons E2 are generated. A part of the reflected electrons E2 are generated on the surface of the target T, when the electrons E1 are reflected while little kinetic energy is being lost. The reflected electrons E2 fly inside the X-ray tube 3. Then, the reflected electrons E2 are incident on a side wall of the anode 61 (target supporting portion 20). These incident electrons further generate the reflected electrons E2. The generated reflected electrons E2 are incident on the outer cylinder portion 12*b*. The electrons incident on the outer cylinder portion 12*b* are the electrons E3. There is a possibility that the electrons E3 will cause electrification in the outer cylinder portion 12*b*.

The outer cylinder portion 12*b* on which electrons E3 are incident includes the low resistivity glass portion 71 having a relatively low volume resistivity. As a result, the electrons E3 incident on the low resistivity glass portion 71 easily flow toward the ring member 14. Therefore, the low resistivity glass portion 71 can free the electrons E3. As a result of freeing the electrons E3, the insulation valve 12 is unlikely to be electrified. Therefore, deterioration in withstand voltage of the insulation valve 12 is curbed, and electric discharge is curbed.

Based on this viewpoint, in the outer cylinder portion 12*b*, it is desirable that a region in which the electrons E3 may be incident be formed by the low resistivity glass portion 71. A part of the outer cylinder portion 12*b* on the target T side may be the low resistivity glass portion 71.

[Electrons Being Incident Due to Field Emission]

Incidentally, in addition to the reflected electrons E2, there are also other electrons electrifying the insulation valve 12. Specifically, electrons electrifying the insulation valve 12 indicate electrons generated due to field emission. Field emission is a phenomenon in which electrons are emitted to a surrounding electric field from a place with a negative potential. Specifically, field emission occurs when the vacuum housing 10 has a potential which becomes relatively negative with respect to the potential of the inner space S. For example, this state occurs when a high positive voltage is applied to the anode 61 and the vacuum housing 10 (metal portion 13) has the ground potential, as in the X-ray tube 3 illustrated in FIG. 1. A high positive voltage is 100 kV, for example. That is, field emission occurs when a high positive voltage is applied to the anode 61 and the metal portion 13 has the ground potential. The vacuum housing 10 includes a part in which the glass coupling portion 74 is joined to the ring member 14. In this joint part, a space in a vacuum state, an insulating material, and a metal are in contact with each other. In other words, in this joint part, the inside of the vacuum housing 10, the glass coupling portion 74, and the ring member 14 are in contact with each other. Such a joint part is referred to as a triple junction 75. In the triple junction 75, an electric field is likely to be concentrated. Therefore, the intensity of an electric field in the triple junction 75 is likely to be relatively higher than that of its surroundings. The triple junction 75 emits electrons to the vacuum side due to field emission. In other words, the triple junction 75 emits electrons into the insulation valve 12. These emitted electrons E4 are incident on the inner wall surface of the outer cylinder portion 12*b*, similar to the electrons E3. As a result, the inner wall surface of the outer cylinder portion 12*b* is electrified.

The insulation valve 12 is a combination of the low resistivity glass portion 71 and the high resistivity glass portion 72 differing from each other in volume resistivity. According to this combination, the distribution of an electric field generated inside the insulation valve 12 can be controlled. Specifically, due to the combination of the low resistivity glass portion 71 and the high resistivity glass portion 72, the intensity of an electric field generated in the triple junction 75 is weakened. The electric field is likely to be concentrated at a place with a high volume resistivity. Therefore, in the insulation valve 12, the low resistivity glass portion 71 having a relatively low volume resistivity is disposed on the triple junction 75 side. According to this configuration, the intensity of an electric field generated in the vicinity of the triple junction 75 is weakened. Therefore, field emission is curbed. The insulation valve 12 is unlikely to be electrified by preventing electrons from being incident on the insulation valve 12. As a result, deterioration in withstand voltage of the insulation valve 12 is curbed, and electric discharge is curbed.

[Operational Effects]

In the X-ray tube 3 using the insulation valve 12, electrons generated inside the X-ray tube 3 are incident on the insulation valve 12 sometimes. Due to these incident electrons, the insulation valve 12 is electrified. As a result, a withstand voltage of the insulation valve 12 deteriorates sometimes. For example, the electrons E1 emitted from the electron gun 11 are incident on the target T. A part of the electrons E1 of electrons incident on the target T are reflected by the target T without being converted into X-rays or heat. There are cases in which the reflected electrons E2 are incident on the insulation valve 12. From the viewpoint of efficiency of utilizing X-rays, the target T is often provided in the vicinity of the X-ray emission window 33*a*. When the target T is provided in the vicinity of the X-ray emission window 33*a*, the reflected electrons E2 are likely to be incident on a side joined to the metal portion 13 of the insulation valve 12 in which the X-ray emission window 33*a* is provided. Therefore, the insulation valve 12 of the X-ray tube 3 has the low resistivity glass portion 71 joined to the metal portion 13 and the high resistivity glass portion 72 for fixing the target T (anode 61). The volume resistivity of a material forming the low resistivity glass portion 71 is lower than the volume resistivity of a material forming the high resistivity glass portion 72. According to this configuration, the electrons E3 incident on the low resistivity glass portion 71 easily move. As a result, electrification of the insulation valve 12 can be curbed. Therefore, deterioration in withstand voltage can be curbed, and it is possible to minimize electric discharge caused by electrification. Sometimes field emission occurs in the triple junction 75 on a side of the insulation valve 12 joined to the metal portion 13. The low resistivity glass portion 71 having a relatively low volume resistivity is disposed on the triple junction 75 side of the insulation valve 12. As a result, the intensity of an electric field generated in the vicinity of the triple junction 75 is curbed. Therefore, field emission is curbed. That is, electrification of the insulation valve 12 can be curbed by preventing electrons from being incident on the insulation valve 12. As a result, deterioration in withstand voltage can be curbed, and it is possible to minimize electric discharge caused by electrification. In addition, field emission is also accompanied by generation of heat. This heat causes gas to be emitted from neighboring members. Therefore, the degree of vacuum inside the vacuum housing 10 deteriorates. As a result, the possibility of electric discharge increases. However, generation of heat is also curbed by curbing field emission. As a result, it is possible to minimize electric discharge caused by deterioration in degree of vacuum.

The insulation valve 12 controls a surface resistance value based on characteristics of a material forming the insulation valve 12. Examples of methods for the insulation valve 12 controlling the surface resistance value include a configuration in which an additional member for controlling the surface resistance value is attached to a surface of an insulation valve. However, according to the configuration of the insulation valve 12, compared to the foregoing configuration, it is possible to eliminate uncertain factors such as an influence of uneven coating and peeling off of a coated layer. Therefore, the surface resistance value can be reliably controlled.

The insulation valve 12 has the glass joint portion 73 for joining the low resistivity glass portion 71 to the high resistivity glass portion 72. According to this configuration, the low resistivity glass portion 71 and the high resistivity glass portion 72 can be joined to each other at a desired position. As a result, a region of the insulation valve 12 in which electrification is curbed can be controlled in a desired form. Moreover, the distribution of an electric field generated inside the insulation valve 12 can be controlled in a desired form.

The insulation valve 12 has the outer cylinder portion 12*b*, the inner cylinder portion 12*a*, and the coupling portion 12*c*. The outer cylinder portion 12*b* includes the low resistivity glass portion 71. The inner cylinder portion 12*a* is disposed inside the outer cylinder portion 12*b*. The inner cylinder portion 12*a* includes the high resistivity glass portion 72. The coupling portion 12*c* causes the outer cylinder portion 12*b* to be coupled to the inner cylinder portion 12*a*. According to this configuration, the overall length of the insulation valve 12 is lengthened. Therefore, creeping discharge occurring in the inner wall of the insulation valve 12 can be curbed.

The outer cylinder portion 12*b* includes the glass joint portion 73. According to this configuration, a region in which the electrons E3 and the electrons E4 may be incident is formed by the low resistivity glass portion 71. As a result, electrification of the insulation valve 12 can be curbed. The intensity of an electric field generated at the joint place between the insulation valve 12 and the metal portion 13 can be decreased. As a result, generation of unnecessary electrons E4 can be curbed.

The metal portion 13 has the protrusion portion 313 disposed between the insulation valve 12 and the anode 61 (target supporting portion 60). The protrusion portion 313 covers the joint part between the metal portion 13 and the low resistivity glass portion 71. According to this configuration, the reflected electrons E2 can be suitably prevented from being incident on the insulation valve 12. It is possible to curb electric discharge at the joint place between the insulation valve 12 and the metal portion 13. Therefore, the intensity of an electric field can be weakened. As a result, generation of unnecessary electrons E4 can be curbed.

The volume resistivity of a material forming the low resistivity glass portion 71 is within a range of $10^{-5}$ times to $10^{-2}$ times the volume resistivity of a material forming the high resistivity glass portion 72. According to this configuration, a desired electric field distribution can be realized between the target supporting portion 60 and the metal portion 13. Therefore, electrification of the insulation valve 12 can be stably curbed.

The material forming the low resistivity glass portion 71 and the material forming the high resistivity glass portion 72 are glasses. According to this configuration as well, the insulation valve 12 having a desired volume resistivity can be easily manufactured.

Hereinabove, the embodiment of the present invention has been described. However, the present invention is not limited to the foregoing embodiment. The present invention can be variously modified within a range not departing from the gist thereof. That is, the shape, the material, and the like of each of the units in the X-ray tube are not limited to the shapes, the materials, and the like specified in the foregoing embodiment.

First Modification Example

Figure 2:
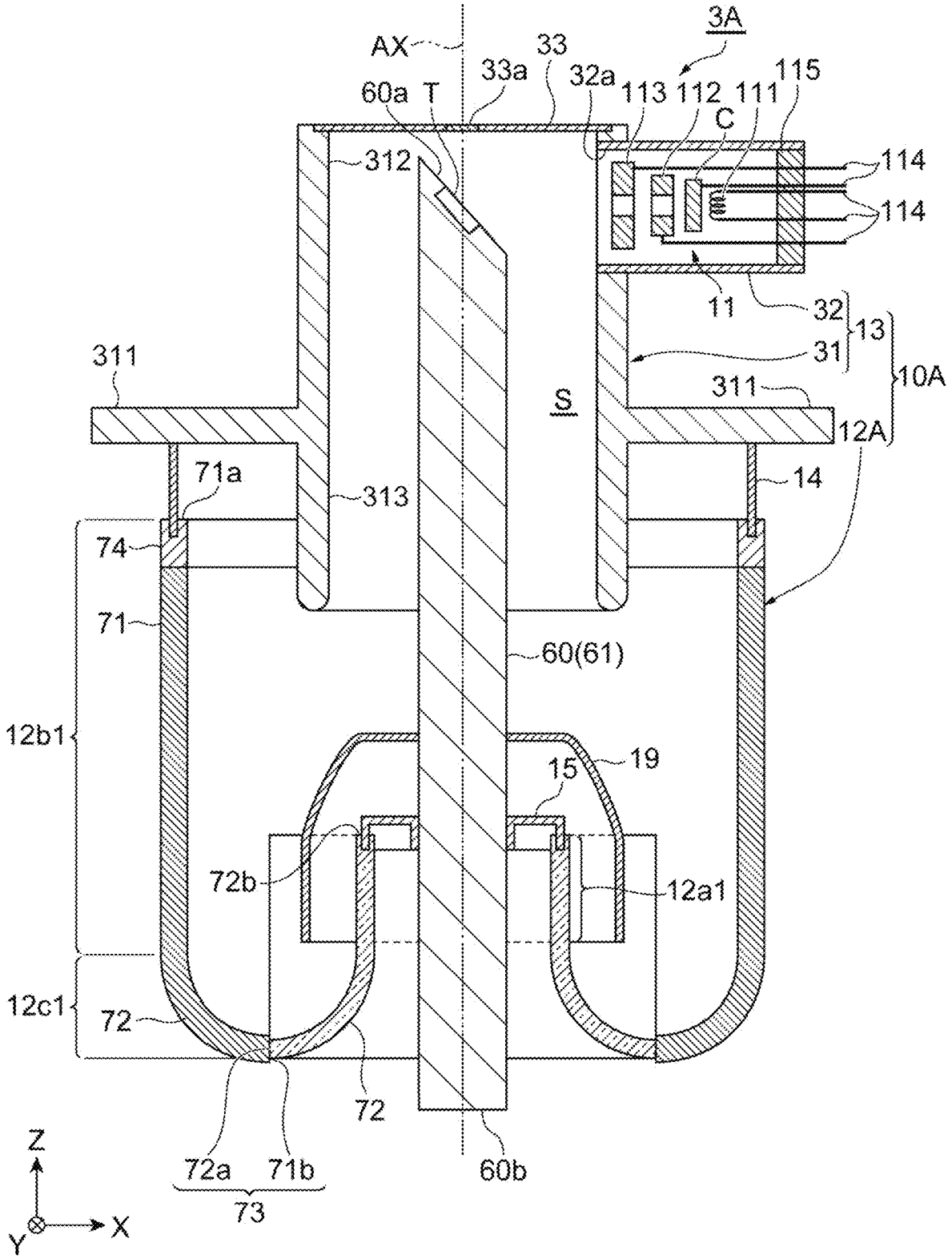
FIG. 2 is a cross-sectional view illustrating a configuration of an X-ray tube of a first modification example.

As illustrated in FIG. 2, an X-ray tube 3A of a first modification example has a vacuum housing 10A. The vacuum housing 10A has an insulation valve 12A in place of the insulation valve 12. The glass joint portion 73 of the insulation valve 12A is provided in a coupling portion 12*c*1. For example, the glass joint portion 73 may be provided in the apex portion of the coupling portion 12*c*1. In this configuration, an outer cylinder portion 12*b*1 in its entirety is constituted of the low resistivity glass portion 71. An inner cylinder portion 12*a*1 in its entirety is constituted of the high resistivity glass portion 72. The coupling portion 12*c*1 includes the low resistivity glass portion 71 and the high resistivity glass portion 72. The coupling portion 12*c*1 has an arc-shaped cross section. A part of the coupling portion 12*c*1 connected to the outer cylinder portion 12*b*1 is the low resistivity glass portion 71. A part connected to the inner cylinder portion 12*a*1 is the high resistivity glass portion 72. According to this configuration, a range in which the electrons E3 or the electrons E4 may be incident is constituted of the low resistivity glass portion 71. A range in which the electrons E3 or the electrons E4 may be incident is the outer cylinder portion 12*b*1. That is, the outer cylinder portion 12*b*1 is constituted of the low resistivity glass portion 71. Therefore, electrification of the insulation valve 12A can be suitably curbed.

Second Modification Example

Figure 3:
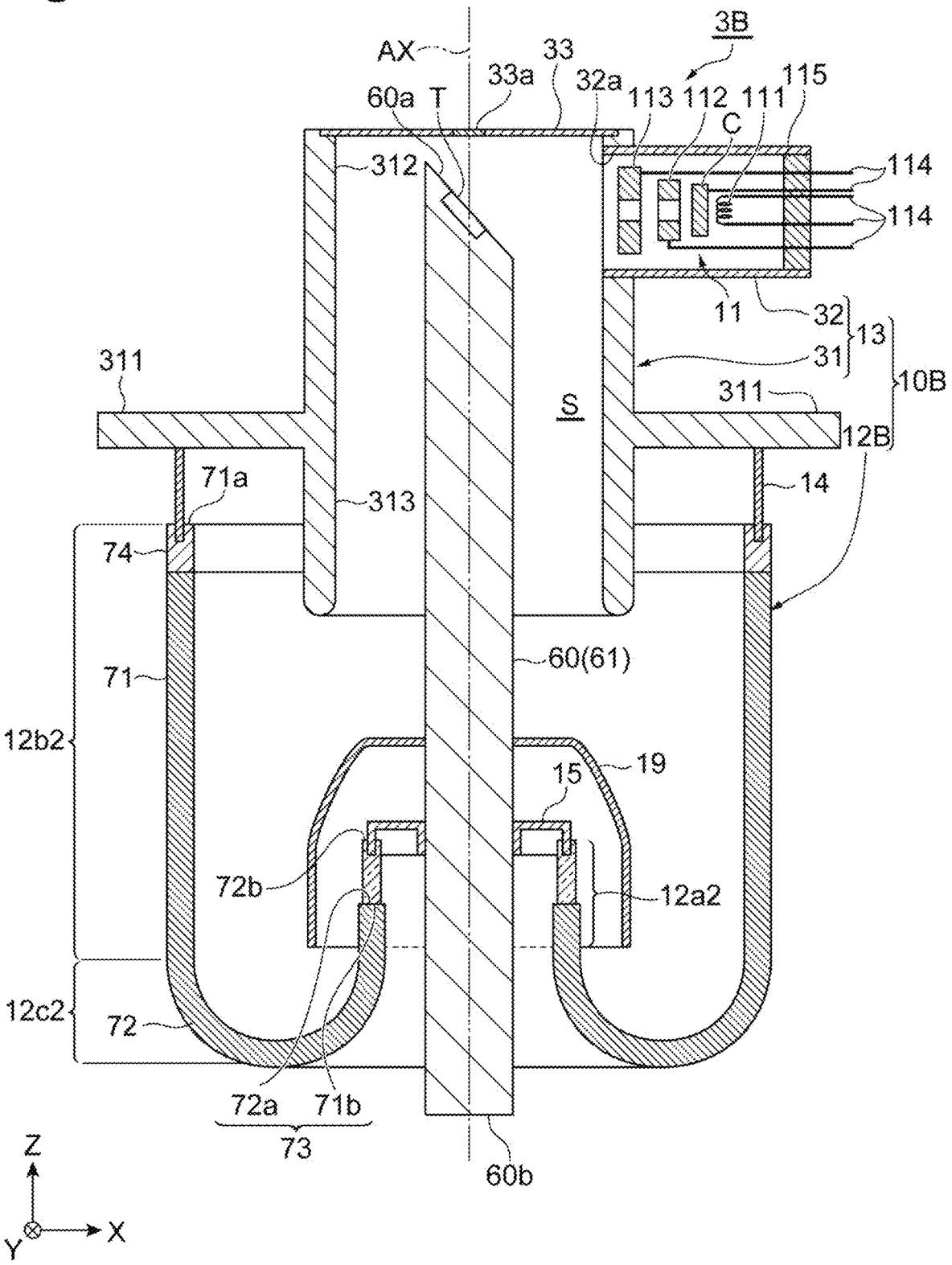
FIG. 3 is a cross-sectional view illustrating a configuration of an X-ray tube of a second modification example.

As illustrated in FIG. 3, an X-ray tube 3B of a second modification example has a vacuum housing 10B. The vacuum housing 10B has an insulation valve 12B in place of the insulation valve 12. The glass joint portion 73 of the insulation valve 12B of the second modification example is provided in an inner cylinder portion 12*a*2. For example, the glass joint portion 73 is covered with the cover electrode 19. The cover electrode 19 is disposed between the glass joint portion 73 and an outer cylinder portion 12*b*2. In this configuration, the outer cylinder portion 12*b*2 in its entirety is constituted of the low resistivity glass portion 71. A coupling portion 12*c*2 in its entirety is constituted of the low resistivity glass portion 71. The inner cylinder portion 12*a*2 includes the low resistivity glass portion 71 and the high resistivity glass portion 72. According to this configuration as well, a range in which the electrons E3 or the electrons E4 may be incident is constituted of the low resistivity glass portion 71. In other words, the outer cylinder portion 12*b*2 is constituted of the low resistivity glass portion 71. Therefore, electrification of the insulation valve 12B can be suitably curbed.

Third Modification Example

Figure 4:
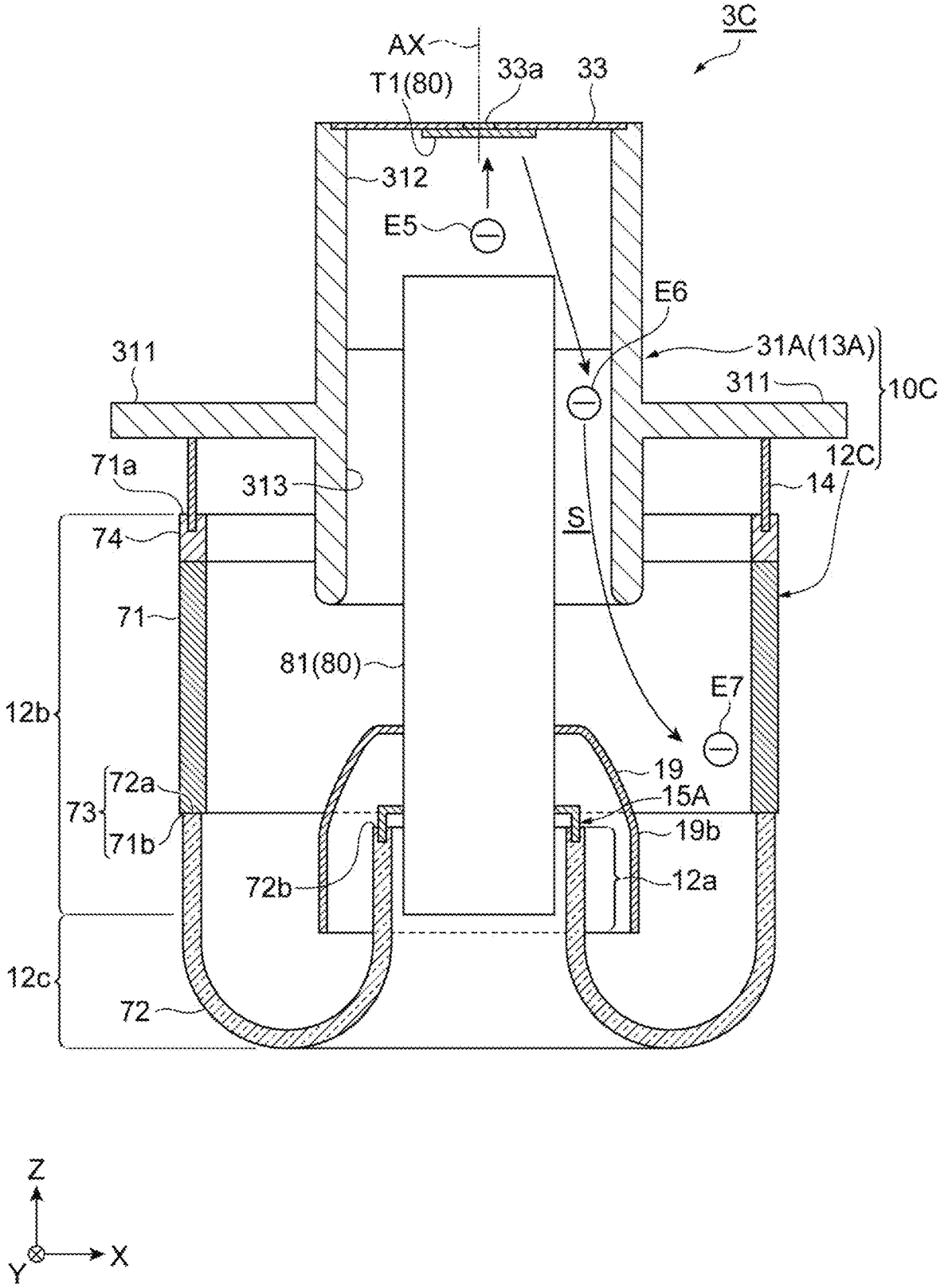
FIG. 4 is a cross-sectional view illustrating a configuration of an X-ray tube of a third modification example.

In the foregoing embodiment, a reflective device has been described as an example of an X-ray generation unit. As illustrated in FIG. 4, an X-ray tube 3C of a third modification example has a vacuum housing 10C and an X-ray generation unit 80. The vacuum housing 10C has a metal portion 13A including a main body portion 31A, and an insulation valve 12C. The X-ray generation unit 80 is a device of a transmission type. The X-ray generation unit 80 of a transmission type has an electron gun 81 and a target T1. The electron gun 81 is disposed inside the vacuum housing 10C. The electron gun 81 emits electrons E5 in the direction of the tube axis AX. For example, the center axis line of the cylindrical electron gun 81 overlaps the tube axis AX. The end portion of the electron gun 81 on a side opposite to an emission unit is coupled to the inner cylinder portion 12*a* of the insulation valve 12C with a fixing portion 15A interposed therebetween. The target T1 is disposed on the rear surface of the X-ray emission window 33*a*. The electrons E5 emitted from the electron gun 81 are incident on the target T1. Due to the incident electrons E5, X-rays are generated.

In the X-ray tube 3C having the X-ray generation unit 80, a part of the electrons E5 incident on the target T1 become reflected electrons E6. A part of the reflected electrons E6 become electrons E7 incident on the outer cylinder portion 12*b* of the insulation valve 12. Due to the incident electrons E7, electrification occurs in the insulation valve 12.

Electrification of the insulation valve 12 can be curbed and electric discharge can be curbed even by the X-ray tube 3C having the X-ray generation unit 80 of a transmission type.

Fourth Modification Example

In the insulation valve 12 according to the embodiment, the low resistivity glass portion 71 has a constant volume resistivity. However, the volume resistivity of an insulation valve is not limited to such a form. The volume resistivity of a low resistivity glass portion does not have to be constant. The volume resistivity of an insulation valve may change from one end portion toward the other end portion. For example, the volume resistivity of a low resistivity glass portion may gradually increase from the end portion joined to the metal portion 13 toward the glass joint portion 73. The volume resistivity of the high resistivity glass portion 72 may gradually increase from the glass joint portion 73 toward the end portion joined to the anode 61 (target supporting portion 60). According to this configuration, an insulation valve having a desired volume resistivity can be easily manufactured.

Fifth Modification Example

As in the fourth modification example, for example, a low resistivity glass portion having a gradient in volume resistivity includes a plurality of partition wall piece portions differing from each other in volume resistivity. The plurality of partition wall piece portions may be joined to each other. The low resistivity glass portion includes a plurality of first partition wall piece portions differing from each other in volume resistivity. The plurality of first partition wall piece portions may be disposed such that the volume resistivity increases from the end portion joined to the metal portion 13 toward the glass joint portion 73. The same applies to a high resistivity glass portion. In brief, the high resistivity glass portion includes a plurality of second partition wall piece portions differing from each other in volume resistivity. The plurality of second partition wall piece portions may be disposed such that the volume resistivity increases from the glass joint portion 73 toward the end portion joined to the anode 61 (target supporting portion 60). According to this configuration as well, an insulation valve having a desired volume resistivity can be easily obtained.

Sixth Modification Example

In the insulation valve 12 of the embodiment, the low resistivity glass portion 71 and the high resistivity glass portion 72 are separate components. Then, in the insulation valve 12, the low resistivity glass portion 71 is joined to the high resistivity glass portion 72. However, a configuration for achieving the effect of curbing electric discharge is not limited to this configuration. In an insulation valve, if the volume resistivity on the metal portion 13 side is lower than the volume resistivity on the anode 61 (target supporting portion 60) side, the effect of curbing electric discharge can be achieved. An insulation valve is included in an X-ray tube of a sixth modification example is an integrated glass article. Moreover, the volume resistivity of the insulation valve included in the X-ray tube of the sixth modification example may continuously change from the end portion joined to the metal portion 13 toward the end portion joined to the anode 61 (target supporting portion 60). In other words, the insulation valve of the sixth modification example includes a low resistivity glass portion and a high resistivity glass portion. Then, the insulation valve of the sixth modification example is an integrated body. Moreover, the insulation valve of the sixth modification example is formed such that the volume resistivity continuously increases from the low resistivity glass portion toward the high resistivity glass portion. The insulation valve of the sixth modification example has no glass joint portion. According to this configuration as well, an insulation valve having a desired volume resistivity can be easily obtained.

Analysis Example

States of electric fields formed inside an insulation valve were checked through numerical analysis. Hereinafter, results of the numerical analysis will be described. Equipotential lines were obtained through this numerical analysis. According to the results of the numerical analysis, the states of electric fields generated inside the insulation valve can be ascertained. Therefore, according to the results of the numerical analysis, for example, the degree of field emission can be estimated.

Figure 5:
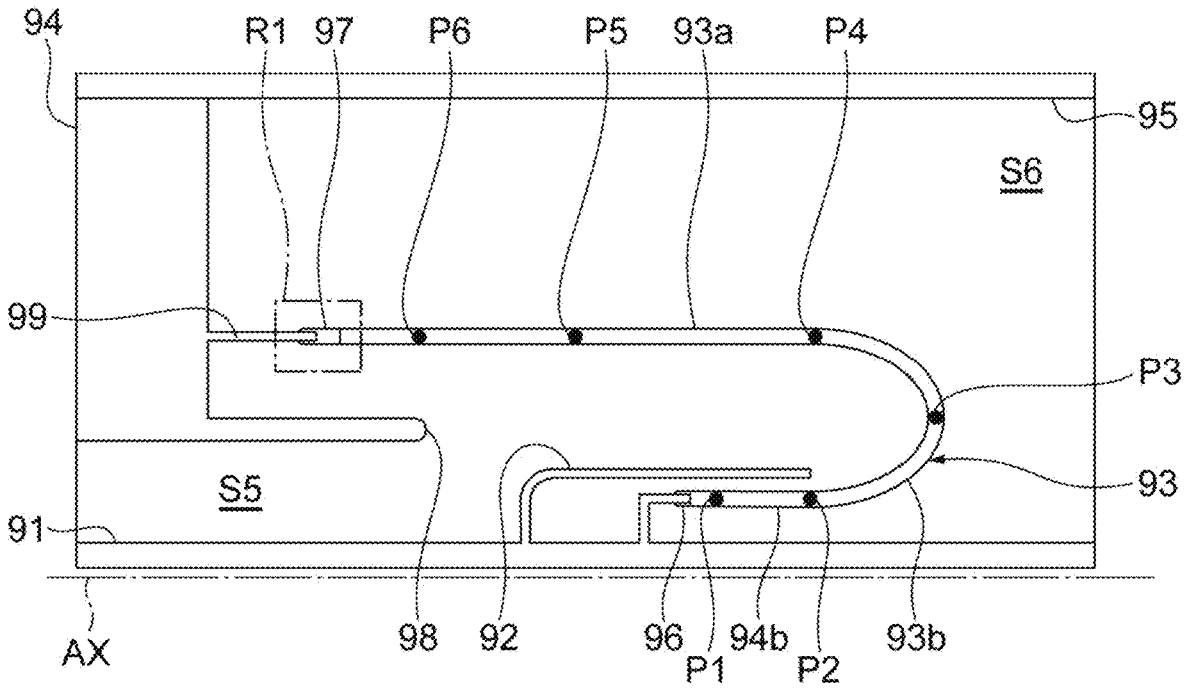
FIG. 5 is an end surface diagram illustrating an analytical model.

A model illustrated in FIG. 5 was adopted in the numerical analysis. The model was realized by simplifying the X-ray tube 3 illustrated in FIG. 1 and the like. The model included an anode 91, an electrode cover 92, an insulation valve 93, and a metal portion 94, as a configuration of an X-ray tube. Moreover, the model had an X-ray tube accommodation portion 95 as a metal container for accommodating the X-ray tube. The electrode cover 92 covered a connection portion 96. The connection portion 96 was a portion in which the insulation valve 93 was connected to the anode 91. The insulation valve 93 included a low resistivity glass portion 93*a* and a high resistivity glass portion 94*b*. The low resistivity glass portion 93*a* was coupled to a cylinder portion 99 of the metal portion 94 with Kovar glass 97 interposed therebetween. A region surrounded by the anode 91, the insulation valve 93, and the metal portion 94 was a region S5. The region S5 was in a vacuum state. A region surrounded by the X-ray tube accommodation portion 95, the metal portion 94, the insulation valve 93, and the anode 91 was a region S6. The region S6 was filled with an insulating oil.

The model of the numerical analysis had a cross section as illustrated in FIG. 5 and was rotationally symmetrical around the tube axis AX. Moreover, as an input condition, a potential difference was provided between the metal portion 94 and the anode 91. Specifically, the voltages of the X-ray tube accommodation portion 95 and the metal portion 94 were set to 0 V. Moreover, the voltage of the anode 91 was set to 100 kV.

In the numerical analysis, two parameters were set. A first parameter was the position of the glass joint portion 73. The position of the glass joint portion 73 was set to six different positions. Then, equipotential lines were obtained from each of the configurations. A second parameter was the ratio of the volume resistivity of the low resistivity glass portion 93*a* to the volume resistivity of the high resistivity glass portion 94*b*. The ratio of the volume resistivities was set to five different ratios. Then, equipotential lines were obtained from each of the ratios.

[Positions of Glass Joint Portion]

Figures 6A, 6B, 6C, 6D, 6E, 6F:
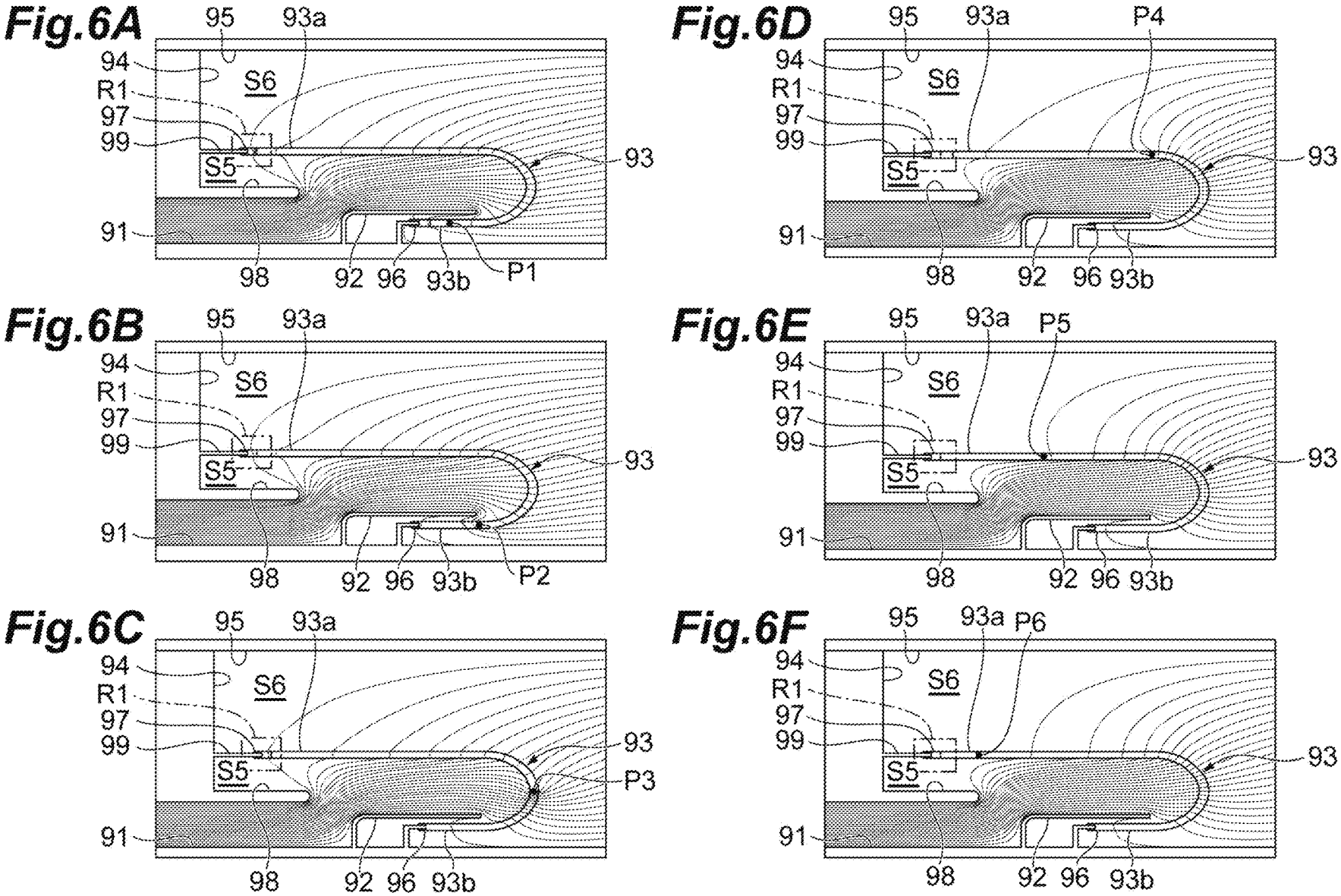
FIG. 6A is a view illustrating equipotential lines as a result of a first analysis example.
FIG. 6B is a view illustrating equipotential lines as a result of a second analysis example.
FIG. 6C is a view illustrating equipotential lines as a result of a third analysis example.
FIG. 6D is a view illustrating equipotential lines as a result of a fourth analysis example.
FIG. 6E is a view illustrating equipotential lines as a result of a fifth analysis example.
FIG. 6F is a view illustrating equipotential lines as a result of a sixth analysis example.

A point P1 indicates the position of the glass joint portion 73 in a model of a first analysis example. In the first analysis example, the glass joint portion 73 was set in a region in which the electrode cover 92 and the anode 91 faced each other. In the first analysis example, the inner cylinder portion 12*a* included the low resistivity glass portion 93*a* and a high resistivity glass portion 93*b*. FIG. 6A illustrates equipotential lines of the first analysis example.

A point P2 indicates the position of the glass joint portion 73 in a model of a second analysis example. In the second analysis example, the glass joint portion 73 was set at a boundary position between the inner cylinder portion 12*a* and the coupling portion 12*c*. FIG. 6B illustrates equipotential lines of the second analysis example.

A point P3 indicates the position of the glass joint portion 73 in a model of a third analysis example. In the third analysis example, the glass joint portion 73 was set in the coupling portion 12*c*. Specifically, the position of the glass joint portion 73 was set in the apex portion of an arc of a circle which appeared when the coupling portion 12*c* was viewed in a cross section. FIG. 6C illustrates equipotential lines of the third analysis example.

A point P4 indicates the position of the glass joint portion 73 in a model of a fourth analysis example. In the fourth analysis example, the glass joint portion 73 was set at a position facing an end portion of the electrode cover 92. This position was a boundary between the outer cylinder portion 12*b* and the coupling portion 12*c*. The outer cylinder portion 12*b* of the insulation valve 93 of the fourth analysis example included the low resistivity glass portion 93*a*. The low resistivity glass portion 93*a* faced the anode 91, the electrode cover 92, and a protrusion portion 98. FIG. 6D illustrates equipotential lines of the fourth analysis example.

A point P5 indicates the position of the glass joint portion 73 in a model of a fifth analysis example. In the fifth analysis example, the glass joint portion 73 was set at a position facing the electrode cover 92. A part corresponding to an outer cylinder portion of the insulation valve 93 of the fifth analysis example included the low resistivity glass portion 93*a* and the high resistivity glass portion 94*b*. The low resistivity glass portion 93*a* faced the anode 91, the electrode cover 92, and the protrusion portion 98. FIG. 6E illustrates equipotential lines of the fifth analysis example.

A point P6 indicates the position of the glass joint portion 73 in a model of a sixth analysis example. In the sixth analysis example, the glass joint portion 73 was set at a position facing the protrusion portion 98. The greater part of the insulation valve 93 of the sixth analysis example was constituted of the high resistivity glass portion 94*b*. FIG. 6F illustrates equipotential lines of the sixth analysis example.

A region R1 including a joint portion between the cylinder portion 99 and the Kovar glass 97 will be stipulated. That is, the region R1 includes the triple junction 75 illustrated in FIG. 1. Attention was focused on the equipotential lines generated in the regions R1 of the first analysis example to the sixth analysis example. The equipotential lines of the first analysis example illustrated in FIG. 6A, the equipotential lines of the second analysis example illustrated in FIG. 6B, and the equipotential lines of the third analysis example illustrated in FIG. 6C were checked. As a result, in all of the analysis examples, a state in which an electric field was concentrated in the region R1 could be confirmed. That is, it was ascertained that there was a high possibility of occurrence of field emission at the positions of the glass joint portion 73 in the models of the first, second, and third analysis examples.

The equipotential line of the fourth analysis example illustrated in FIG. 6D, the equipotential lines of the fifth analysis example illustrated in FIG. 6E, and the equipotential lines of the sixth analysis example illustrated in FIG. 6F were checked. As a result, in all of the analysis examples, a state in which an electric field was concentrated in the region R1 could not be confirmed. It was ascertained that there was a low possibility of occurrence of field emission at the positions of the glass joint portion 73 in the models of the fourth, fifth, and sixth analysis examples. Therefore, it was ascertained that field emission generated in the triple junction 75 could be curbed at the positions of the glass joint portion 73 indicated in the models of the fourth, fifth, and sixth analysis examples.

If the outer cylinder portion of the insulation valve 93 is formed with the low resistivity glass portion 93*a*, electrification of the insulation valve 93 can be curbed. That is, electrification of the insulation valve 93 can be curbed at the positions of the glass joint portion 73 indicated in the models of the first to fifth analysis examples.

It was ascertained that field emission could be curbed and electrification could be curbed at the positions of the glass joint portion 73 indicated in the models of the fourth and fifth analysis examples. The insulation valve 93 was associated with the model of the fifth analysis example. Therefore, the insulation valve 93 could curb the concentration of an electric field generated in the vicinity of the triple junction 75. As a result, it could be confirmed that the insulation valve 93 could suitably curb field emission.

[Ratio of Volume Resistivity]

An influence of the ratio of the volume resistivity of the low resistivity glass portion 93*a* to the volume resistivity of the high resistivity glass portion 94*b* on the equipotential lines was checked. In this checking, the model of the fifth analysis example was used. Regarding the ratio of the volume resistivity of the low resistivity glass portion 93*a* to the volume resistivity of the high resistivity glass portion 94*b*, the volume resistivity of the high resistivity glass portion 94*b* was set to 1 time (seventh analysis example), $10^1$ times (eighth analysis example), $10^2$ times (ninth analysis example), $10^3$ times (tenth analysis example), and $10^4$ times (eleventh analysis example) while having the low resistivity glass portion 93*a* as a reference. In other words, regarding the ratio, the volume resistivity of the low resistivity glass portion 93*a* was set to 1 time, $10^{-1}$ times, $10^{-2}$ times, $10^{-3}$ times, and $10^{-4}$ times while having the high resistivity glass portion 94*b* as a reference.

Figure 7D:
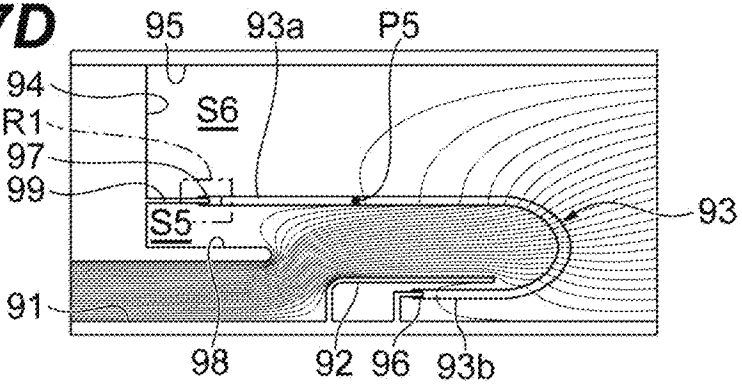
FIG. 7D is a view illustrating equipotential lines as a result of a tenth analysis example.
Figure 7E:
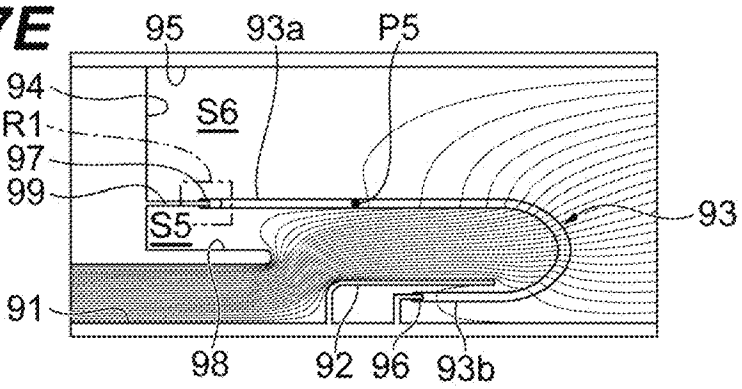
FIG. 7E is a view illustrating equipotential lines as a result of an eleventh analysis example.
Figure 7A:
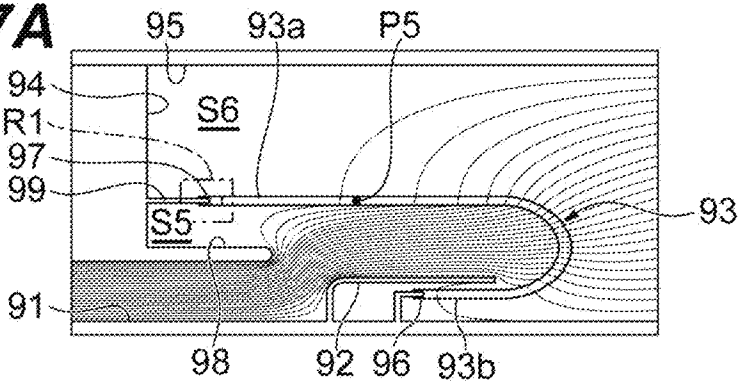
FIG. 7A is a view illustrating equipotential lines as a result of a seventh analysis example.
Figure 7B:
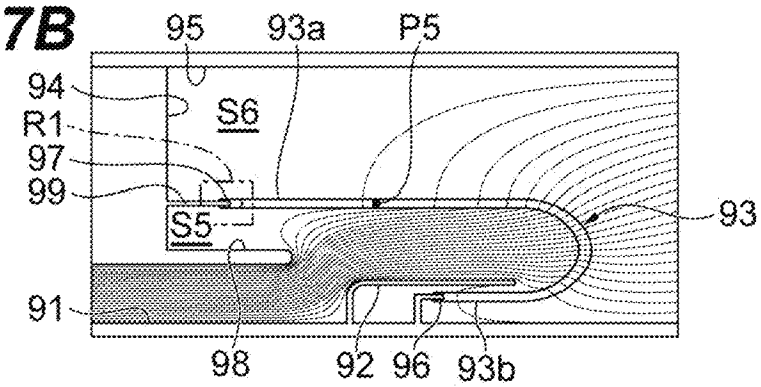
FIG. 7B is a view illustrating equipotential lines as a result of an eighth analysis example.
Figure 7C:
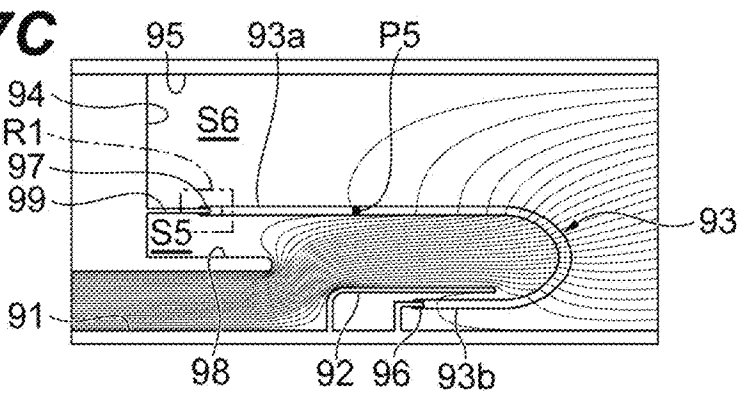
FIG. 7C is a view illustrating equipotential lines as a result of a ninth analysis example.

FIG. 7A illustrates a result of the seventh analysis example. FIG. 7B illustrates a result of the eighth analysis example. FIG. 7C illustrates a result of the ninth analysis example. FIG. 7D illustrates a result of the tenth analysis example. FIG. 7E illustrates a result of the eleventh analysis example.

In the seventh to eleventh analysis examples, attention was focused on the difference between the density of the equipotential lines generated in a region constituted of the low resistivity glass portion 93*a* and the density of the equipotential lines generated in a region constituted of the high resistivity glass portion 93*b*. It was ascertained that the density of the equipotential lines was higher in a region constituted of the high resistivity glass portion 93*b* in the ninth, tenth, and eleventh analysis examples, compared to the seventh and eighth analysis examples. That is, it could be confirmed that the equipotential lines of the ninth, tenth, and eleventh analysis examples manifested the state in which an electric field was more concentrated than the equipotential lines of the seventh and eighth analysis examples. As a result, according to the models of the ninth, tenth, and eleventh analysis examples, it could be confirmed that concentration of an electric field generated in the region R1 present on a side of a region constituted of the low resistivity glass portion 93*a* could be curbed. That is, it could be confirmed that concentration of an electric field generated in the triple junction 75 as illustrated in FIG. 1 could be curbed. Moreover, as a result, according to the models of the ninth, tenth, and eleventh analysis examples, it could be confirmed that field emission occurring in the region R1 present on a side of a region constituted of the low resistivity glass portion 93*a* could be curbed. When the density of the equipotential lines of the tenth analysis example was compared with the density of the equipotential lines of the eleventh analysis example, no predominant difference could be confirmed. That is, it was ascertained that the volume resistivity which was deteriorated more than necessary did not significantly affect the density of the equipotential lines. However, when the volume resistivity is deteriorated, the amount of a current flowing in the low resistivity glass portion 93*a* is increased. That is, when the volume resistivity is deteriorated, insulation performance of the low resistivity glass portion 93*a* is deteriorated. Therefore, in general consideration regarding the ratio of the volume resistivity, it was ascertained that the volume resistivity of the high resistivity glass portion 94*b* was suitably set within a range of $10^2$ times to $10^5$ times while having the low resistivity glass portion 93*a* as a reference. In other words, in the case of having the high resistivity glass portion 94*b* as a reference, the volume resistivity of the low resistivity glass portion 93*a* might be set within a range of $10^{-5}$ times to $10^{-2}$ times.

[Operation of Protrusion Portion]

A part forming the triple junction 75 was covered with the protrusion portion 98. In other words, the protrusion portion 98 was disposed between a part forming the triple junction 75 and the target supporting portion 60. An operation of the protrusion portion 98 was checked through the numerical analysis.

Figure 8A:
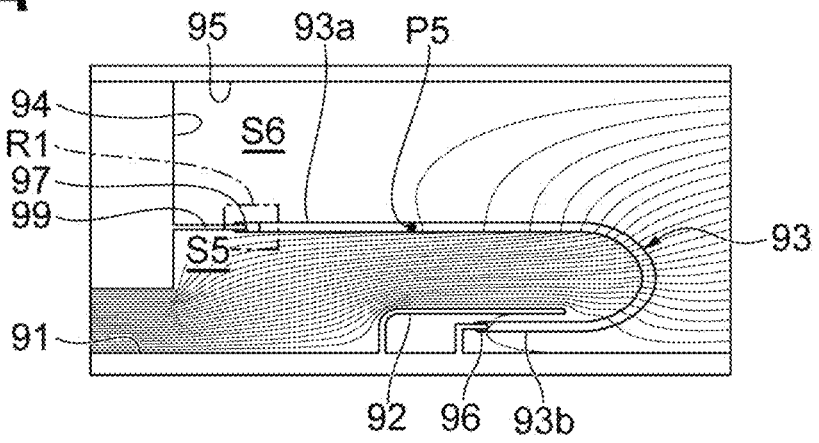
FIG. 8A is a view illustrating equipotential lines as a result of a twelfth analysis example.
Figure 8B:
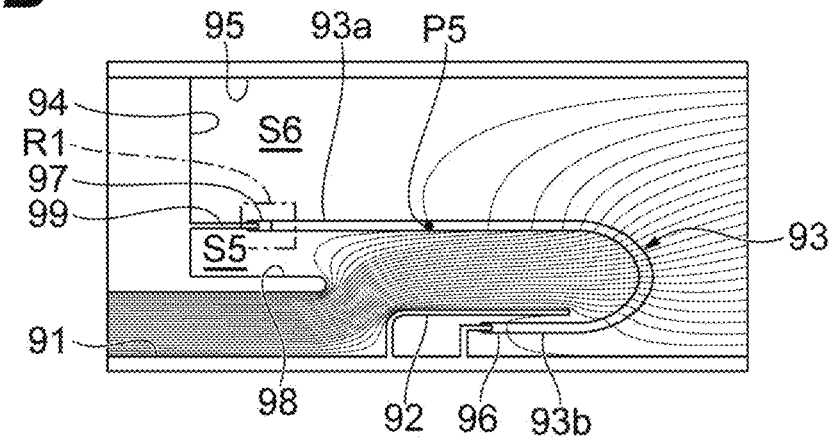
FIG. 8B is the view illustrating equipotential lines as a result of the fifth analysis example.

In a model of a twelfth analysis example, the protrusion portion in the model of the fifth analysis example was removed. FIG. 8A illustrates a result of the twelfth analysis example. FIG. 8A illustrates a result of the equipotential lines. FIG. 8B illustrates a result of the fifth analysis example again.

Attention was focused on the region R1 in the vicinity of the triple junction 75. When the protrusion portion 98 was present (fifth analysis example), it was confirmed that no strong electric field was formed. In contrast, when no protrusion portion 98 was present (twelfth analysis example), it was confirmed that a strong electric field was formed. Therefore, it could be confirmed that the protrusion portion 98 has an operation of weakening an electric field generated in the region R1 in the vicinity of the triple junction 75.

What is claimed is:

1. An X-ray tube comprising:

a metal portion in which an X-ray emission unit is provided;

a valve portion which is joined to the metal portion and forms a vacuum region in cooperation with the metal portion; and an electron gun and a target which are accommodated in the vacuum region, wherein the valve portion has a first partition wall portion joined to the metal portion, and a second partition wall portion for fixing either of the electron gun or the target, wherein a volume resistivity of a material forming the first partition wall portion is lower than a volume resistivity of a material forming the second partition wall portion, and wherein the material forming the first partition wall portion is an insulating material.

2. The X-ray tube according to claim 1, wherein the valve portion has a partition wall joint portion in which the first partition wall portion is joined to the second partition wall portion.

3. The X-ray tube according to claim 2, wherein the valve portion has a first cylinder portion which includes the first partition wall portion, a second cylinder portion which is disposed inside the first cylinder portion and includes the second partition wall portion, and a coupling portion which causes the first cylinder portion to be coupled to the second cylinder portion.

4. The X-ray tube according to claim 3, wherein the first cylinder portion includes the partition wall joint portion.

5. The X-ray tube according to claim 3, wherein the coupling portion includes the partition wall joint portion.

6. The X-ray tube according to claim 3, wherein the second cylinder portion includes the partition wall joint portion.

7. The X-ray tube according to claim 2, wherein the volume resistivity of the first partition wall portion increases from an end portion joined to the metal portion toward the partition wall joint portion.

8. The X-ray tube according to claim 2, wherein the first partition wall portion includes a plurality of first partition wall piece portions differing from each other in volume resistivity, and wherein the plurality of first partition wall piece portions are disposed such that a volume resistivity increases from an end portion joined to the metal portion toward the partition wall joint portion.

9. The X-ray tube according to claim 2, wherein the volume resistivity of the second partition wall portion increases from the partition wall joint portion toward an end portion joined to either of the electron gun or the target.

10. The X-ray tube according to claim 2, wherein the second partition wall portion includes a plurality of second partition wall piece portions differing from each other in volume resistivity, and wherein the plurality of second partition wall piece portions are disposed such that a volume resistivity increases from the partition wall joint portion toward an end portion joined to either of the electron gun or the target.

11. The X-ray tube according to claim 1, wherein the metal portion has a protrusion portion covering a joint part between the metal portion and the first partition wall portion.

12. The X-ray tube according to claim 1, wherein the valve portion is an integrated body formed such that the volume resistivity continuously increases from the first partition wall portion toward the second partition wall portion.

13. The X-ray tube according to claim 1, wherein the volume resistivity of a material forming the first partition wall portion is within a range of $10^{-5}$ times to $10^{-2}$ times the volume resistivity of a material forming the second partition wall portion.

14. The X-ray tube according to claim 1, wherein the material forming the first partition wall portion and the material forming the second partition wall portion are glasses.

15. An X-ray tube comprising:

a metal portion in which an X-ray emission unit is provided;

a valve portion which is joined to the metal portion and forms a vacuum region in cooperation with the metal portion; and an electron gun and a target which are accommodated in the vacuum region, wherein the valve portion has a first partition wall portion joined to the metal portion, and a second partition wall portion for fixing either of the electron gun or the target, wherein a volume resistivity of a material forming the first partition wall portion is lower than a volume resistivity of a material forming the second partition wall portion, and wherein the material forming the first partition wall portion and the material forming the second partition wall portion are glasses.

* * * * *